United States Patent [19]

Gatt

[11] Patent Number: 4,921,101

[45] Date of Patent: May 1, 1990

[54] RACK FOR SUN ROOF MODULES

[75] Inventor: Edward W. Gatt, Richmond, Mich.

[73] Assignee: Chrysler Corporation, Highland Park, Mich.

[21] Appl. No.: 405,158

[22] Filed: Sep. 11, 1989

[51] Int. Cl.[5] ..... B65D 85/48

[52] U.S. Cl. ..... 206/451; 206/454; 206/509; 206/596; 206/821; 206/335

[58] Field of Search ..... 206/451, 452, 448, 454, 206/386, 596, 335

[56] References Cited

U.S. PATENT DOCUMENTS

| | | | |
|---|---|---|---|
| 3,147,860 | 9/1964 | Kean, Sr. et al. | 206/448 |
| 3,927,764 | 12/1975 | Fox | 206/451 |
| 3,964,608 | 6/1976 | Rowley | 206/451 |
| 3,985,231 | 10/1976 | Farhat et al. | 206/451 X |
| 3,995,738 | 12/1976 | Rowley et al. | 206/451 |
| 4,010,849 | 3/1977 | Pater et al. | 206/451 |
| 4,014,435 | 3/1977 | Rowley et al. | 206/451 X |

FOREIGN PATENT DOCUMENTS

| | | | |
|---|---|---|---|
| 68857 | 9/1969 | Fed. Rep. of Germany | 206/451 |
| 2447325 | 9/1980 | France | 206/454 |
| 1043072 | 9/1983 | U.S.S.R. | 206/454 |

*Primary Examiner*—William Price

*Attorney, Agent, or Firm*—Edward A. Craig

[57] ABSTRACT

The present invention is a rack for shipping sun roof modules including a bottom wall having a width and length and an upstanding end wall at each end of the length of the bottom wall. A pair of laterally spaced channel members extend upwardly along each end wall and an insert extends longitudinally and having ends disposed within longitudinally opposed channel members and adapted to receive sun roof modules placed thereon. The insert includes means for allowing successive inserts to be stacked with a sun roof module contained therebetween.

9 Claims, 4 Drawing Sheets

RACK FOR SUN ROOF MODULES

BACKGROUND OF THE INVENTION

1. Field of the Invention

The present invention relates generally to shipping rack, and more particularly to, a shipping rack for sun roof modules.

2. Description of Related Art

Sun roofs are commonly found in current automotive vehicles. The sun roof is produced in a module which is installed in an opening in the roof of the vehicle. The sun roof module typically includes a frame surrounding a pane of transparent material such as glass. A drive mechanism such as a motor for moving the pane of glass is disposed laterally outside the frame.

It has become a problem in that during forklift loading or unloading of the shipping racks onto or off of railroad boxcars damage may occur to the drive mechanism because they are vulnerable in extended positions. This may be due to the difficulties in controlling forklifts in general or to errant operation of the forklift, but in any case the drive mechanisms are often broken or bent requiring repair or replacement of the drive mechanisms, which is costly in both repair costs and down time.

It is, therefore, one object of the present invention to provide a shipping rack especially for shipping sun roof modules.

It is another object of the present invention to provide a shipping rack for sun roof modules which is returnable along with returnable dunnage.

It is yet another object of the present invention to provide a shipping rack for sun roof modules which protects the drive mechanism from being damaged.

SUMMARY OF THE INVENTION

The present invention is a rack for shipping sun roof modules including a bottom wall having a width and length and an upstanding end wall at each end of the length of the bottom wall. A pair of laterally spaced channel members extend upwardly along each end wall and an insert extends longitudinally and having ends disposed within longitudinally opposed channel members and adapted to receive sun roof modules placed thereon. The insert includes means for allowing successive inserts to be stacked with a sun roof module contained therebetween.

Accordingly, the present invention provides a shipping rack especially for sun roof modules. The present invention also provides an efficient means of stacking sun roof modules in a shipping rack. The present invention protects the drive mechanism from being damaged. Further, the present invention is returnable along with returnable dunnage or inserts.

Other objects, features and advantages of the present invention will become more fully apparent from the following description of the preferred embodiment, the appended claims and in the accompanying drawings.

DESCRIPTION OF THE PREFERRED EMBODIMENT

Figures 1, 11:
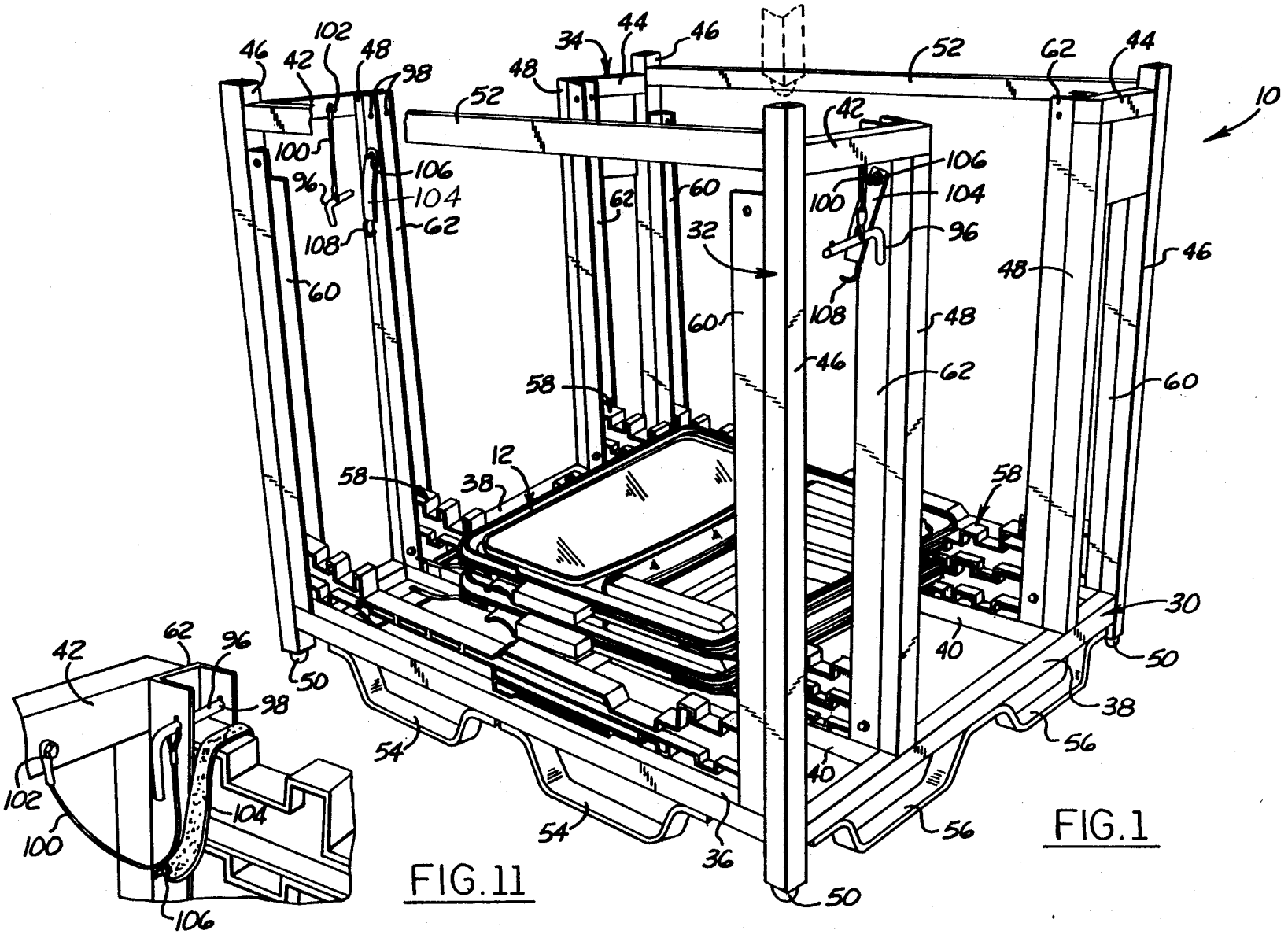
FIG. 1 is a perspective view of a shipping rack for sun roof modules according to the present invention.
FIG. 11 is a partial perspective view of a corner of the shipping rack of FIG. 1.
Figure 4:
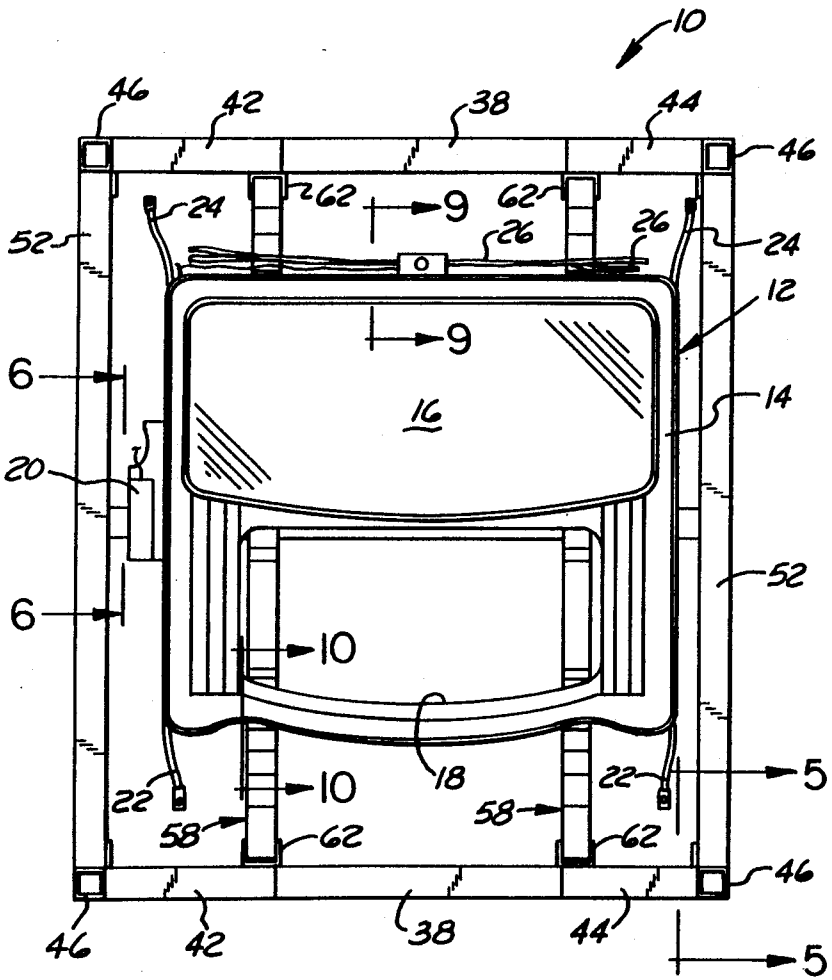
FIG. 4 is a top plan view of the shipping rack of FIG. 4.

Referring to FIG. 1, it will be noted that a shipping rack 10 according to the present invention is shown for shipping or transporting sun roof modules, generally indicated at 12. Referring to FIG. 4, the sun roof module 12 includes a generally rectangular frame 14. The frame 14 encloses a generally rectangular pane of transparent material 16 such as glass. The pane of transparent material 16 is disposed at one end of the frame 14. The frame 14 also includes a generally rectangular opening 18 at its other end. The pane of transparent material is adapted to translate between a first position adjacent the opening 18, as shown in the figure, and a second position disposed over the opening 18. The sun roof module 12 includes a drive mechanism 20 such as a motor to drive or translate the pane of transparent material 16 between the first and second positions. The sun roof module 12 also includes a pair of laterally spaced and longitudinally extending forward and rearward extension arms 22 and 24, respectively, to allow the frame 14 to be secured to the roof of the vehicle. The sun roof module 12 further includes a plurality of laterally extending rods 26 at the rearward end of the frame 14 for attachment to the roof of the vehicle.

Figure 3:
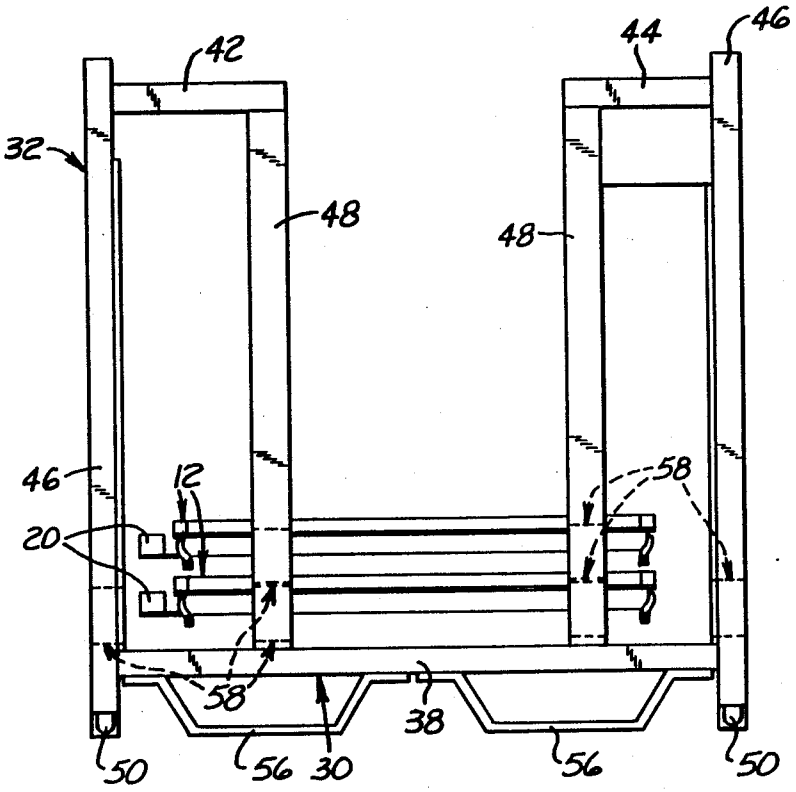
FIG. 3 is a side elevational view of the shipping rack of FIG. 1.
Figure 2:
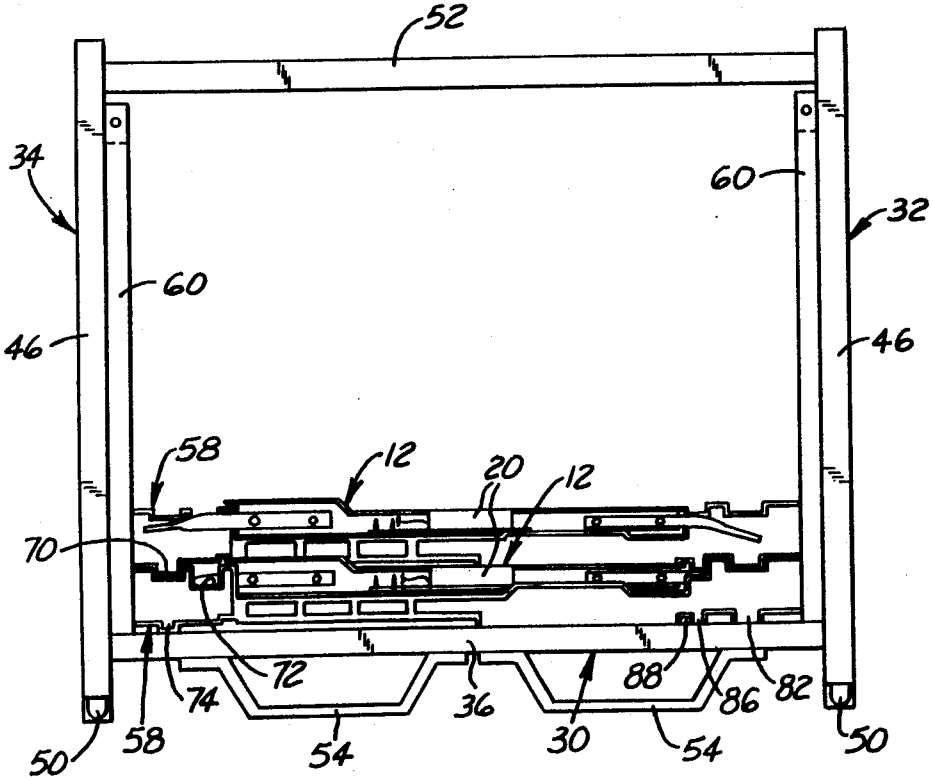
FIG. 2 is a front elevational view of the shipping rack of FIG. 1.
Figure 5:
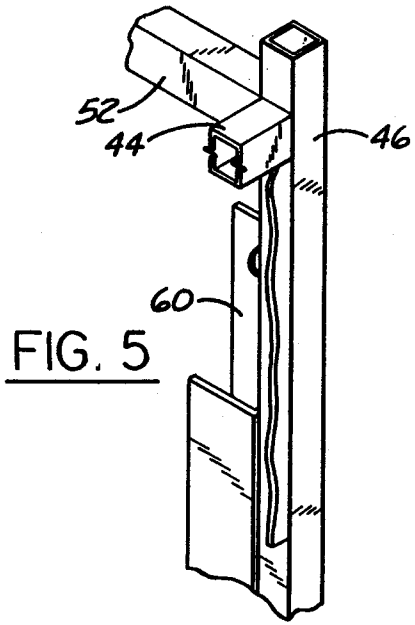
FIG. 5 is a sectional view taken along line 5—5 of FIG. 4.

Referring to FIGS. 1 through 3, the shipping rack 10 includes a bottom wall, generally indicated at 30, having a width and a length with upstanding end walls, generally indicated at 32 and 34, at each end of the length of the bottom wall 30. The bottom and end walls are fabricated from welded tubular steel. Plastic materials may alternatively be used for fabrication purposes.

The bottom wall 30 comprises a frame consisting of side rail members 36 and end rail members 38. Extending between these members are laterally spaced longitudinal elements 40 which define a striped-like pattern. As will be appreciated, the bottom wall 30 provides vertical support for the sun roof modules 12 which are loaded thereon.

Each of the end walls 32 and 34 comprises a frame having upper rails 42 and 44 and outer and inner vertical end rails 46 and 48. Again, these elements may be fabricated of tubular steel and welded together. The vertical rails 46 are welded to the side and end rail members 36 and 38 such that the bottom wall 30 is elevated or raised above a support surface. Feet 50 extend from the outer vertical end rails 46 to contact a support surface for supporting the shipping rack 10. As will be noted in dotted lines, one shipping rack 10 may be loaded on another rack with the feet 50 being received in the hollow upper ends of the tubular vertical rails 46.

The end walls 32 and 34 are separated and supported at their upper ends by upper support members 52. Once again, these elements may be fabricated of tubular steel and welded together. The side rail members 36 and end rail members 38 include a pair of spaced apart loops 54 and 56 to facilitate manipulation of the racks 10 by means of a forklift truck.

The sun roof module 12 is supported in a generally horizontal position by a pair of laterally spaced and longitudinally extending inserts, generally indicated at 58. The inserts 58 allow the sun roof modules 12 to be stacked one upon another within the shipping rack 10. The outer and inner vertical end rails 46 and 48 include a vertically extending and generally "U" shaped outer and inner channel members 60 and 62, respectively. The outer and inner channel members 60 and 62 have their closed end secured to the vertical end rails 46 and 48, respectively, by means such as welding. The outer and inner channel members 60 and 62 provide a track for the ends of the inserts 58 to prevent lateral and longitudinal movement of the inserts 58.

Figure 7:
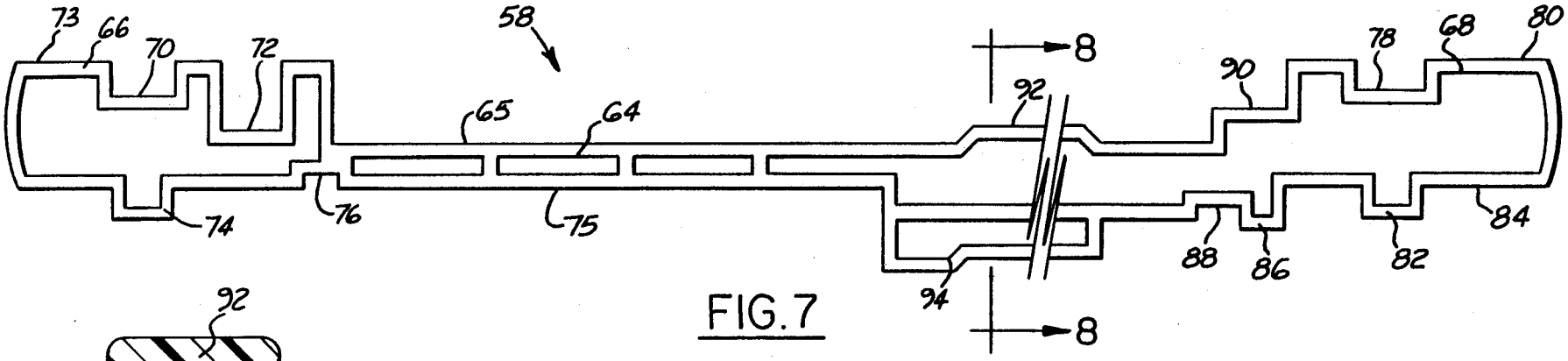
FIG. 7 is an elevational view of an insert for the shipping rack of FIG. 1.

Referring to FIG. 7, the insert 58 includes a body member 64 extending longitudinally with first and second end members 66 and 68 at the ends thereof. The body member 64 also includes an upper surface 65 upon which the frame 14 of the sun module 12 rests. As noted in FIG. 8, the insert 58 has a generally rectangular profile which is adapted for vertical movement within the outer and inner channel members 60 and 62. The outer periphery of the first and second end members 66 and 68 is generally arcuate to facilitate loading and unloading of the insert 58 within the outer and inner channel members 60 and 62.

Figure 9:
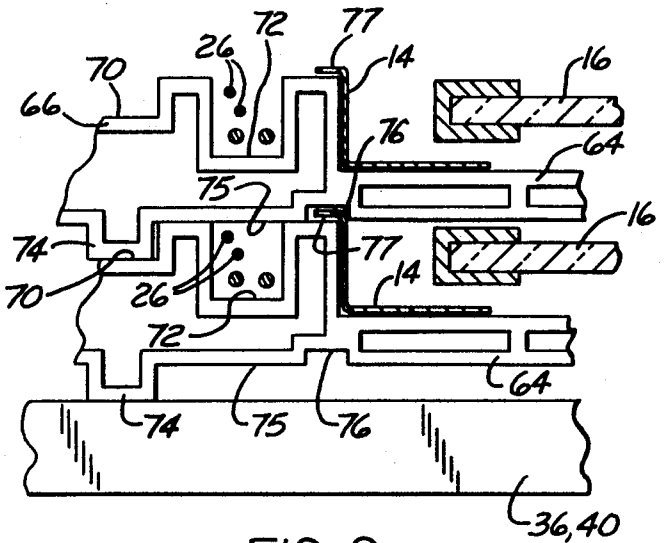
FIG. 9 is a sectional view taken along line 9—9 of FIG. 4.

The first end member 66 includes a pair of longitudinally spaced pockets or recesses 70 and 72 extending downwardly from an upper surface 73 thereof. The upper surface 73 is elevated or raised above the upper surface 65 of the body member 64. The second pocket 72 has a depth greater than the first pocket 70. The first end member 66 also includes a step 74 extending downwardly from a lower surface 75 which is also the lower surface of the body member 64. The step 74 is disposed generally opposite the first pocket 70. The first end member 66 further includes a pocket or recess 76 extending upwardly from the lower surface 75. As illustrated in FIG. 9, the step 74 is disposed in the first pocket 70 when the inserts 58 are stacked. The rods 26 of the sun roof module 12 are contained in the second pocket 72. A rearward portion 77 of the frame 14 of the sun roof module 12 is contained in the recess 76.

Figure 10:
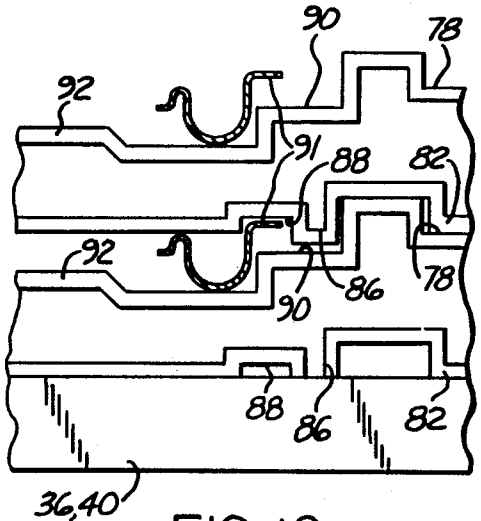
FIG. 10 is a sectional view taken along line 10—10 of FIG. 4.

Referring again to FIG. 7, the second end member 68 includes a third pocket or recess 78 extending downwardly from an upper surface 80 and a second step 82 extending downwardly from a lower surface 84. The second step 82 is disposed opposite the third pocket 78. The second end member 68 also includes a third step 86 spaced longitudinally from the second step 82 and extending downwardly from the lower surface 84. The second end member 68 also includes a second recess or pocket 88 extending upwardly from the lower surface 84. The second end member 68 includes a lower step or shelf 90 disposed below the upper surface 80. As illustrated in FIG. 10, the second step 82 is disposed in the third pocket 78 when the inserts 58 are stacked. A forward portion 91 of the frame 14 is contained in the second recess 88.

Figure 6:
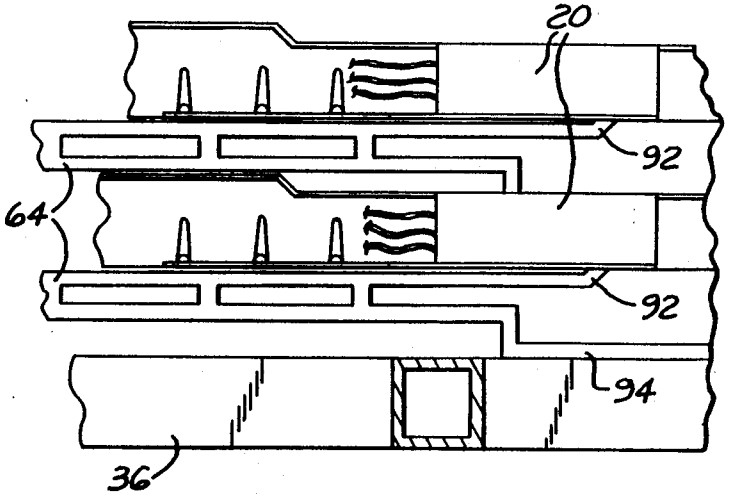
FIG. 6 is a sectional view taken along line 6—6 of FIG. 4.

The body member 64 also includes a raised portion 92 extending upwardly from the upper surface 65 and having a generally trapezoidal profile. Opposite the raised portion 92, the body member 64 includes an inverted L-shaped portion 94 extending downwardly from the lower surface 75. As noted in FIG. 6, the L-shaped portion 94 is configured to cooperate with the raised portion 92 to allow stacking of the inserts 58 and maintain the sun roof module 12 in a generally horizontal position.

Figure 8:
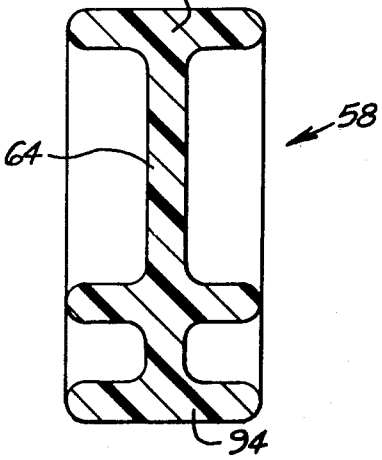
FIG. 8 is a sectional view taken along line 8—8 of FIG. 7.

As illustrated in FIG. 8, the insert 58 has a generally "I" shaped cross-section. The insert 58 may be made of a plastic material, such as high impact styrene.

As illustrated in FIG. 11, a bolt 96 may pass through corresponding holes 98 in the inner channel members 62 to prevent vertical movement or escape of the inserts 58 from the inner channel members 62. The bolt 96 may be attached to a strap 100 which is secured to the member 92 by means such as a fastener 102. Additionally, a flexible or stretchable strap 104 has one end secured by means such as a fastener 106 to the inner channel members 62 and has a hook 108 at the other end which may be hooked or attached to a lower insert 58 to prevent vertical movement of the insert 58 relative to the inner channel members 62.

In operation, the inserts 58 are initially stored in the channel members 60. The first and second end members 66 and 68 fit within the outer channel members 60 such that a first insert 58 rests upon side rail member 36 and successive inserts 58 are stacked one upon the other. When stacked, the steps 74 and 82 are disposed within pockets 70 and 78, respectively, and the lower surfaces 75 and 80 rest upon the upper surfaces 73 and 80, respectively.

When sun roof modules 12 are to be loaded upon the shipping rack 10, a pair of inserts 58 are removed from the outer channel members 60 and disposed within the inner channel members 62 such that the inserts 58 rest upon rail members 40. A sun roof module 12 is loaded upon the inserts 58 such that the frame 14 rests upon the body members 64. Another insert 58 is disposed within each of the inner channel members 62 and stacked successively upon the lower one. As noted in FIGS. 9 and 10, the rods 26 are received within the pocket 72 and the rearward portion 77 is received within the recess 76, while the forward portion 91 is received within recess 88. The operation is reversed for unloading of sun roof modules 12.

Accordingly, the present invention provides a shipping rack 10 for sun roof modules 12. The present invention also provides a returnable shipping rack 10 within which the inserts 58 may be stored for return shipment. Since the sun roof modules 12 are contained within the shipping rack 10, the motor 20 is protected from damage from a forklift truck. Further, the inserts 58 are configured to resist lateral, longitudinal and vertical movement of the sun roof modules 12.

The present invention has been described in an illustrative manner. It is to be understood that the terminology which has been used is intended to be in the nature of words of description rather than of limitation.

Obviously, many modifications and variations of the present invention are possible in light of the above teachings. Therefore, within the scope of the appended claims, the present invention may be practiced otherwise than as specifically described.

What is claimed is:

1. A rack for shipping sun roof modules comprising: a bottom wall having a width and length;

an upstanding end wall at each end of the length of the bottom wall;

a pair of laterally spaced channel members extending upwardly along each end wall;

an insert extending longitudinally and having ends disposed within longitudinally opposed channel members and adapted to receive sun roof modules placed thereon; and said insert including means for allowing successive inserts to be stacked with a sun roof module contained therebetween.

2. A rack as set forth in claim 1 wherein said means comprises a pocket extending downwardly from an upper surface of said ends and a step extending downwardly from a lower surface of said ends, said step adapted to be received in said pocket.

3. A rack as set forth in claim 2 wherein one of said ends includes means forming a second pocket extending downwardly from the upper surface thereof and adapted to contain a portion of the sun roof module.

4. A rack as set forth in claim 3 wherein said ends include means forming a recess extending upwardly from the lower surface thereof and adapted to receive another portion of the sun roof module.

5. A rack as set forth in claim 3 wherein said insert includes a raised portion disposed between said end and extending upwardly and a downward portion disposed opposite said raised portion and extending downwardly, said raised and downward portions adapted to cooperated with each other to allow successive inserts to be stacked.

6. A rack for shipping sun roof modules comprising:

a bottom wall having a width and length;

an upstanding end wall at each end of the length of the bottom wall;

a pair of laterally spaced channel members extending upwardly along each end wall;

an insert extending longitudinally and having ends disposed within longitudinally opposed channel members and adapted to receive sun roof modules placed thereon; and said ends including means forming a pocket extending downwardly from an upper surface thereof and a step extending downwardly from a lower surface thereof, said step adapted to be received in said pocket for allowing successive inserts to be stacked with a sun roof module contained therebetween.

7. A rack as set forth in claim 6 wherein said ends include means forming a second pocket extending downwardly from the upper surface thereof and adapted to contain a portion of the sun roof module; and means forming a recess extending upwardly from the lower surface thereof and adapted to receive another portion of the sun roof module.

8. A rack as set forth in claim 6 including a second pair of laterally spaced channel members extending upwardly along each end wall and adapted to receive said ends of said inserts and allow successive inserts to be stacked when not in use.

9. A rack for shipping sun roof modules comprising:

a bottom wall having a width and length;

an upstanding end wall at each end of the length of the bottom wall;

a pair of laterally spaced channel members extending upwardly along each end wall;

an insert extending longitudinally and having ends disposed within longitudinally opposed channel members and adapted to be loaded with sun roof modules placed thereon; and a second pair of laterally spaced channel members extending upwardly along each end wall and adapted to receive said ends of said inserts and allow successive inserts to be stacked when unloaded to thereby facilitate return shipment.

* * * * *